United States Patent [19]

Wright

[11] Patent Number: 5,063,659

[45] Date of Patent: Nov. 12, 1991

[54] METHOD OF JOINING A SOLDERED CONNECTOR TO A SHIELDED COAXIAL CABLE

[75] Inventor: John O. Wright, York, Pa.

[73] Assignee: GTE Products Corporation, Stamford, Conn.

[21] Appl. No.: 670,622

[22] Filed: Mar. 18, 1991

Related U.S. Application Data

[62] Division of Ser. No. 588,781, Sep. 27, 1990, Pat. No. 5,021,010.

[51] Int. Cl.[5] ..... H01R 43/02

[52] U.S. Cl. ..... 29/860; 29/861

[58] Field of Search ..... 439/578, 874, 585, 598, 439/599, 877, 879, 882, 904, 932, 579–584, 875, 876, 746, 747, 98, 610; 29/857, 860, 861, 862, 863

[56] References Cited

U.S. PATENT DOCUMENTS

| | | | |
|---|---|---|---|
| 3,156,517 | 11/1964 | Maximoff et al. | 439/746 X |
| 3,828,305 | 8/1974 | Hogendobler | 439/385 |
| 3,977,759 | 8/1976 | Maximoff | 439/874 X |
| 4,131,332 | 12/1978 | Hogendobler et al. | 439/585 |
| 4,342,496 | 8/1982 | Hutter et al. | 439/578 |
| 4,397,517 | 8/1983 | Shaffer | 439/747 |
| 4,447,109 | 5/1984 | Hobart, Jr. | 439/874 X |
| 4,690,481 | 9/1987 | Randolph | 439/585 |
| 4,995,838 | 2/1991 | Ayer et al. | 29/860 X |
| 5,025,554 | 6/1991 | Dohi | 29/860 |

FOREIGN PATENT DOCUMENTS

| | | | |
|---|---|---|---|
| 811589 | 4/1959 | United Kingdom | 439/584 |
| 1109914 | 4/1968 | United Kingdom | 439/585 |

*Primary Examiner*—Timothy V. Eley
*Attorney, Agent, or Firm*—William H. McNeill

[57] ABSTRACT

A connector for electrical and mechanical connection to a coaxial cable wherein an inner lead of the cable is soldered to a ferrule which forms part of the connector. The ferrule is fabricated from a strip of material which includes a stripe of solder which will be adjacent an outer surface of such inner lead when the connector has been assembled so that the application of external heat will effect a solder joint between the ferrule and the inner lead.

7 Claims, 4 Drawing Sheets

METHOD OF JOINING A SOLDERED CONNECTOR TO A SHIELDED COAXIAL CABLE

CROSS-REFERENCE TO RELATED APPLICATIONS

This is a division of copending application Ser. No. 07/588,781, filed on Sept. 27, 1990, U.S. Pat. No. 5,021,010.

BACKGROUND OF THE INVENTION

1. Field of the Invention

The present invention relates to a soldered connector for attachment to the end of a shielded coaxial cable for use, for example, in effecting an audio antenna connection.

2. Description of the Prior Art

Heretofore, the typical audio antenna connector has been attached to a coaxial cable by hand. In fabricating such a connector, the inner lead which serves as the signal wire has been soldered to a connector lug. For example, FIG. 1 depicts one known typical female audio antenna connector. Such connector includes a coaxial cable 2 having an end 4 which has been stripped in a known manner such that the signal wire 6 and the signal wire insulator 8 extend from the end 4. The usual shield layer 10 is folded back upon the cable 2. The signal wire insulator 8 is disposed within a plastic sleeve 12 which is disposed within a plastic bushing 14. Bushing 14 is held in place within an outer metal shell 16 by means of a flanged portion 18 of the outer metal shell and an inner metal shell 20 force fit between the shield layer 10 and outer shell 16 and in abutment with the plastic bushing 14 at 22. The electrical connection is completed by manually applying solder and manually soldering the signal wire 6 to a lug 24 at 26. The use of such a solder connection has typically required hand assembly which adds to the cost of fabrication. In addition, a manual soldering operation can result in less than required reliability.

It is desired to provide a connector for electrical connection to a coaxial cable for use, for example, in effecting an audio antenna connection, which connector can be soldered to such cable by hand or automatically. It is also desirable to provide such a connector which can be manufactured at reduced costs. It is also desirable to provide such a connector which can be soldered to a coaxial cable in a cost effective assembly method with inherently high reliability.

SUMMARY OF THE INVENTION

This invention achieves these and other results by providing a connector for electrical and mechanical connection to a shielded coaxial cable which has an end portion including an exposed length of an inner lead and an exposed length of an inner lead insulator extending from the end portion. A shield layer is folded back upon an outer surface of the shielded coaxial cable. The connector includes an elongated metal tubular connector housing extending along a longitudinal axis. A non-conductive bushing is provided internal of and attached at one end of the housing. Such bushing includes a longitudinal bore which extends therethrough along the longitudinal axis, the longitudinal bore having a first end for inserting the exposed length of the inner lead and the exposed length of said inner lead insulator when connecting the shielded coaxial cable to the connector. A metal tubular ferrule is provided having one end for insertion into an opposite second end of the longitudinal bore when connecting the shielded coaxial cable to the connector. Such one end of the tubular ferrule includes an inner portion protruding toward the longitudinal axis and adjacent an outer surface of the inner lead during the insertion. The inner portion includes a solder strip.

BRIEF DESCRIPTION OF THE DRAWINGS

The invention may be clearly understood by reference to the attached drawings in which.

DESCRIPTION OF THE PREFERRED EMBODIMENT

Figure 1:
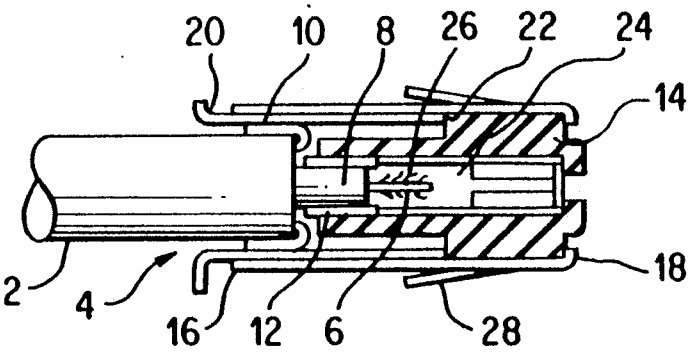
FIG. 1 PRIOR ART
FIG. 1 is a view of a prior art connector of the present invention electrically and mechanically connected to a coaxial cable.
Figure 2:
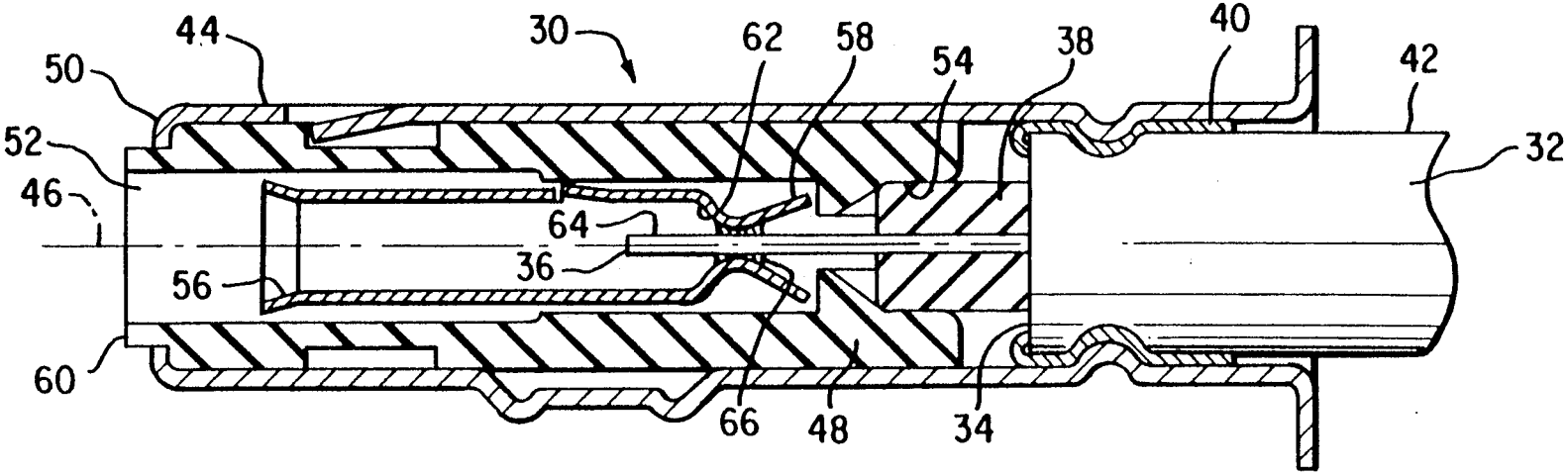
FIG. 2A is a male ferrule for use in a connector of the present invention.

The embodiment which is illustrated in the drawings in one which is particularly suited for achieving the objects of this invention. FIG. 2 depicts a connector 30 for electrical and mechanical connector to a shielded coaxial cable 32 which has an end portion 34 including an exposed length of an inner lead 36 and an exposed length of an inner lead insulator 38 extending from end portion 34. When used to effect an audio antenna connection, the inner lead 36 provides a signal wire in a known manner. A typical shield layer 40 is folded back upon an outer surface 42 of the cable 32. Shielded coaxial cable 32 can be any known shielded coaxial cable useful, for example, in connecting an antenna to a radio or any other antenna application.

The connector 30 includes an elongated metal tubular connector housing 44 which extends along a longitudinal axis 46. A bushing 48 is provided internal of and attached at one end 50 of housing 44. Bushing 48 includes a longitudinal bore 52 extending therethrough along axis 46. Longitudinal bore 52 has a first end 54 for inserting the exposed length of inner lead 36 and the exposed length of inner lead insulator 38 when connecting the shielded coaxial cable 32 to the connector 30.

Figure 2A:
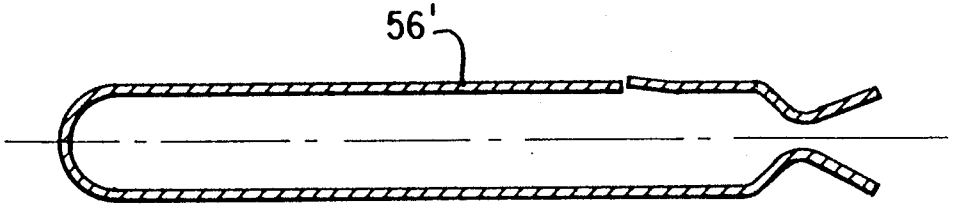

Connector 30 also includes a metal tubular ferrule 56. In the embodiment of FIG. 2, ferrule 56 is a female ferrule. FIG. 2A depicts a male ferrule 56' which is structurally and functionally identical to ferrule 56 with the exception that ferrule 56 provides a male connection and ferrule 56' provides a female connection. Ferrule 56 includes one end 58 for insertion into a second end 60 of the longitudinal bore 52 when connecting the shielded coaxial cable 32 to connector 30. End 58 includes an inner portion 62 which protrudes toward and is adjacent to an outer surface 64 of the inner lead 36 during such insertion. Inner portion 62 includes a solder connection 66 effected from a solder strip as described herein.

Figure 3:
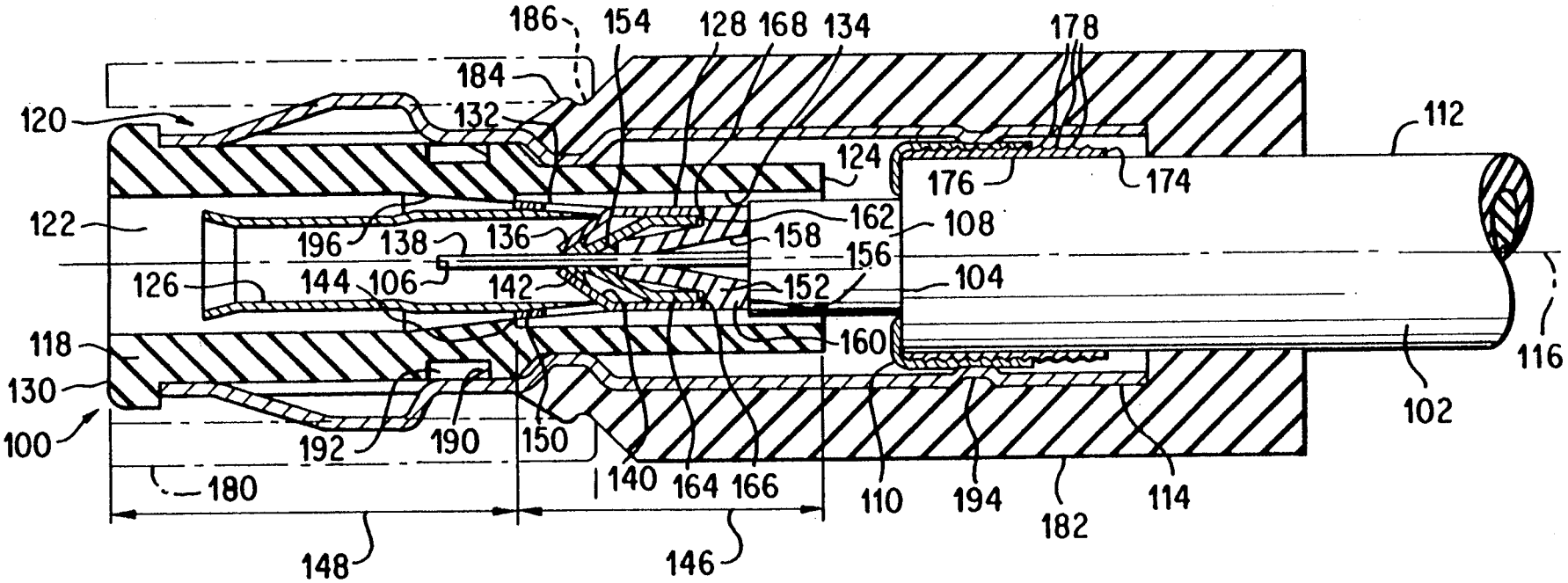
FIG. 3 is an alternate embodiment of the connector of the present invention electrically and mechanically connected to a coaxial cable.

In the preferred embodiment depicted in FIG. 3, a connector 100 is provided for connection to a shielded coaxial cable 102 which includes an end portion 104 having an exposed length of an inner lead 106 and an exposed length of an inner lead insulator 108. A shielded layer 110 is folded back upon an outer surface 112 of the cable 102.

Connector 100 includes an elongated metal tubular connector housing 114 which extends along a longitudinal axis 116. A non-conductive bushing 118 is provided internal of and attached at one end 120 of housing 114. Bushing 118 includes a longitudinal bore 122 extending therethrough along axis 116. Longitudinal bore 122 has a first end 124 for inserting the exposed length of inner lead 106 and the exposed length of inner lead insulator 108 when connecting the shielded coaxial cable 102 to the connector 100.

Connector 100 also includes a metal tubular female ferrule 126. Ferrule 126 includes one end 128 for insertion into an opposite second end 130 of the longitudinal bore 122 when connecting the shielded coaxial cable 102 to connector 100. Ferrule 126 includes at least one retaining tab 132 which extends away from longitudinal axis 116 toward an inner bore wall 134 of longitudinal bore 122 during insertion of the ferrule into the bore. Retaining tab 132 provides a mechanical connection between the ferrule 126 and bushing 118 as described herein. Each retaining tab 132 includes an electrical contact tab 136 which extends toward longitudinal axis 116 against an outer surface 138 of inner lead 106 during insertion of the ferrule into the bore. Electrical contact tab 136 provides a mechanical and electrical connection between the ferrule 126 and inner lead 106. In the preferred embodiment there is a plurality of retaining tabs 132, the embodiment depicted in the drawings including two retaining tabs 132 circumferentially spaced 180°. It will be apparent to those skilled in the art that any other number of such retaining tabs can be used. Electrical contact tab 136 includes an inner surface 140 which protrudes toward axis 116 and is adjacent outer surface 138 of inner lead 106 during insertion of the ferrule into the bushing. Inner surface 140 includes a solder connection 142 effected from a solder strip as described herein.

Figure 3A:
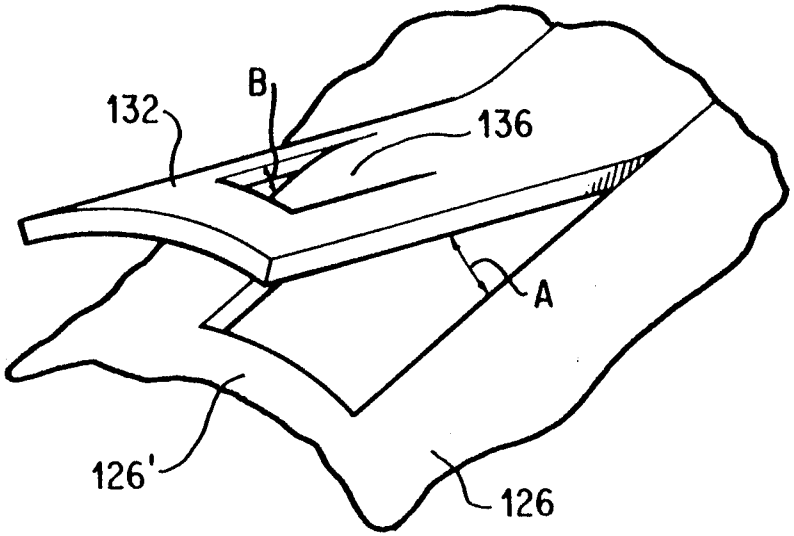
FIG. 3A is an enlarged view of the retaining and electrical contact tabs of the connector of FIG. 3.

In the preferred embodiment, each retaining tab 132 is integral with the metal tubular ferrule and each electrical contact tab 136 is integral with a retaining tab 132 as depicted in FIG. 3A. In the preferred embodiment, ferrule 126 is fabricated from a metal which provides a natural bias or resiliency in tabs 132 and 136 when such tabs are stamped or otherwise angularly oriented relative to the outer surface of the ferrule. In the preferred embodiment each retaining tab 132 protrudes at an angle A away from an axis of the tubular ferrule 126 which axis is coincident with longitudinal axis 116 depicted in FIG. 3, and away from each 128 of ferrule 126. Similary, each electrical contact tab 136 is integral with a respective retaining tab 132 and protrudes at an angle B toward such ferrule axis and away from end 128 of ferrule 126. In the preferred embodiment, angle A is about 15 degrees and angle B is about 15 degrees. Angles A and B are measured relative to the surface 126' of the ferrule 126 which is parallel to the axis of the ferrule.

In the embodiment of FIG. 3, the inner bore wall 134 includes an annular abutment 144 extending therefrom. Annular abutment 144 divides the longitudinal bore 122 into a first bore length 146 adjacent the end 124 of the bushing 118 and a second bore length 148 adjacent an opposite end 130 of the bushing. As depicted in FIG. 3, the distal end 150 of each retaining tab 132 engages the annular abutment 144.

In the preferred embodiment of FIG. 3, the first bore length 146 includes a concentric truncated cone 152 suspended therein an integral with the bushing 118. The cone 152 suspended therein and integral with the bushing 118. The cone 152 includes a small diameter end surface 154 facing the end 130 of bushing 118 and a larger diameter end surface 156 facing the end 124 of the bushing 118. Cone 152 includes an aperture 158 which extends along the longitudinal axis 116. The cone 152 includes a flanged base portion 160 adjacent the larger diameter end surface 156. The flanged base portion 160 forms an abutment surface 162 which faces the end 130 of the bushing 118. A funnel-shaped guide member 164 is positioned upon the cone 152. Guide member 164 includes a larger drainer end surface 166 which is adjacent the abutment surface 162. FIG. 3 depicts the guide member 164 as a separate part. Alternatively, guide member 164 can be integrated into the ferrule during the fabrication thereof, if desired. In any event, the guide member 164 provides an alignment means for the inner lead 106 during insertion of the inner lead into the bushing 118 as described herein. As depicted in FIG. 3, an end surface 168 of end 128 of the ferrule 126 engages abutment surface 162 such that the ferrule is held in place within the bore 122 of bushing 118 by and between the annular abutment 144 which is engaged by retaining tab 132 and the abutment surface 162 which is engaged by end surface 168.

In the preferred embodiment, aperture 158 has a small diameter at the end surface 154 and a larger diameter at the end surface 156, the small diameter being substantially equal to the diameter of the inner lead 106. As depicted in FIG. 3, aperture 158 is funnel shaped.

Figure 4:
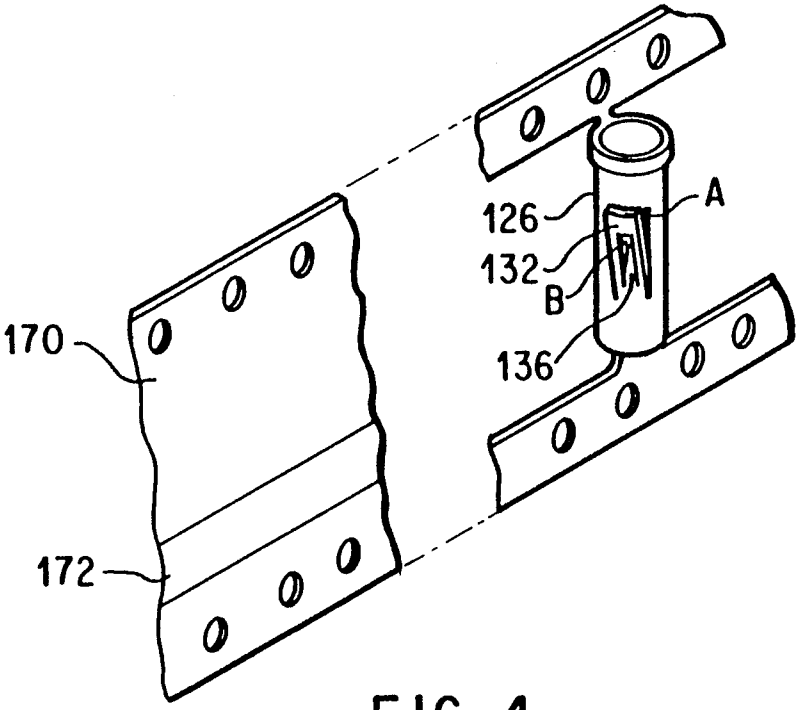
FIG. 4 is a view of a strip of material and a ferrule fabricated therefrom, of the present invention.

In the preferred embodiment, the elongated metal tubular connector housing 114 is fabricated from brass which has been nickel plated with a copper underplate. Similarly, the ferrule 126 is fabricated from brass which has been preplated with nickel with a copper underplate. As depicted in FIG. 4, ferrule 126 can be fabricated from a strip 170 of such material. In accordance with the present invention, the strip 170 includes a solder stripe 172 positioned such that stripe 172 will be on the inner surface 140 of electrical contact tabs 136 of ferrule 126 as such ferrule is fabricated from strip 170 in a known manner. During the joining of the connector 100 to the cable 102, the solder stripe 172 is caused to reflow to form the solder joint 142. Such solder can comprise, without limitation, 60% tin and 40% lead. In the preferred embodiment, bushing 118 is fabricated from a thermoplastic material which is capable of being subjected to the solder reflow process without sustaining any deleterious effects. An example of such a thermoplastic material is sold by Hoechst Celanese under the trademark CELENEX 3310. In the embodiment of FIG. 3, the funnel-shaped guide member 164 is fabricated from brass which has been solder plated. In the preferred embodiment, the length of shield layer 110 is folded back upon an outer surface 112 of cable 102 in such a manner as to sandwich therebetween a clamp or jacket strip 174 which is in the form of a sleeve having a smooth internal surface 176 and an outer surface comprising a plurality of circumferential parallel protuberances 178. The clamp 174 is preferably fabricated from tin plate. The embodiment of FIG. 3 provides a female connector for connection to an antenna base 180 which forms no part of the present invention. To facilitate such connection an overmold 182 is provided which provides a snap fit, between overmold protuberance 184 and antenna base protuberance 186, when the connector 100 is inserted into the antenna base in a known manner. In the embodiment of FIG. 3, the overmold is fabricated from, for example, an elastomer such as is sold by Monsanto under the trademark Santoprene. The various materials referred to throughout this specification are by way of example only.

Figure 5:
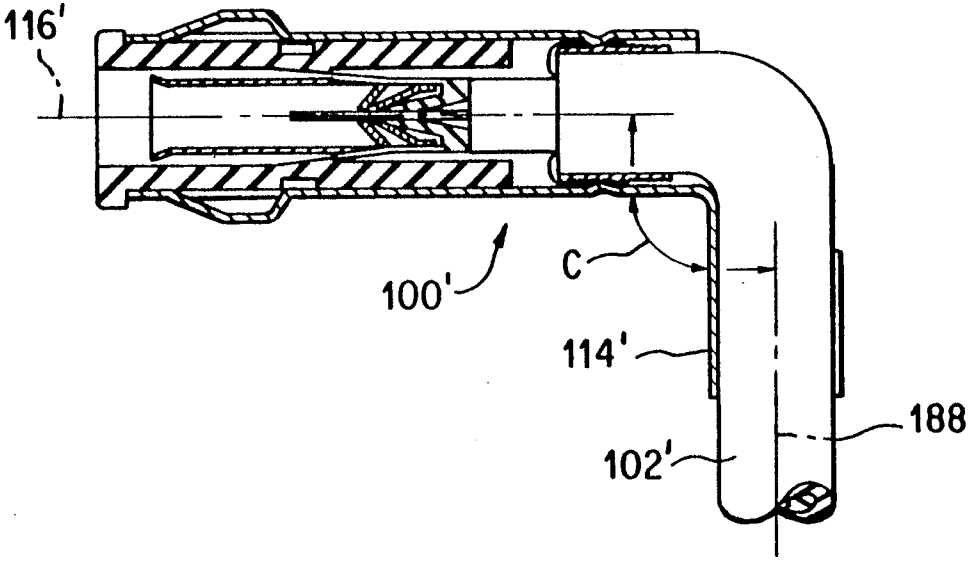
FIG. 5 is an alternate embodiment of the connector of FIG. 3.

The embodiment of FIG. 3 is provided for those applications wherein it is desired to provide a non-angular connection between a connector 100 and cable 102. FIG. 5 depicts a further embodiment wherein an angular connector 100' is provided. In particular, the connector 100' includes an elongated metal tubular connector housing identical to housing 114 of FIG. 3 with the exception that in the housing depicted in FIG. 5 an angular extension 114' is provided. As can be seen from FIG. 5, such an angular extension allows a cable 102' to be inserted to effect and angle C identified by an axis 188 of extension 114' and the longitudinal axis 166' of the housing. In the embodiment of FIG. 5, angle C is 90 degrees although extension 114' can be oriented at any desired angle. The connector 100' is similar to connector 100 in all other respects.

The method of joining a connector of the present invention to a shielded coaxial cable will now be explained with particular reference to FIG. 3 although such method is equally applicable to the other embodiments described herein. Initially, an end of the cable 102 is stripped in a known manner to expose a length of inner lead 106 and a length of shield layer 110. In the embodiments described herein a length of inner lead insulator 108 is also provided although in some embodiments the present invention can be practiced without a length of inner lead insulator. Subsequent to such stripping, the length of shield layer 110 is folded back upon an outer surface 112 of the cable 102 in such a manner as to sandwich the clamp 174 between the cable surface 112 and the shield layer 110. The connector is initially prepared by inserting the bushing 118 into end 120 of the elongated metal tubular connector housing 114 and affixing the housing to the bushing by, for example, crimping the housing at 190 into a recess 192 of the bushing. The end 104 of the cable 102 is next inserted into the opposite end of the housing 114 such that the length of inner lead 106 extends along axis 116 into end 124 of the longitudinal bore 122 of the bushing 118. The apertured cone 152 serves as a guide for inner lead 106. The housing 114 is then affixed to cable 102 by, for example, crimping the housing at 194 causing the housing to bear upon cable 102 through the shield layer 110 and clamp 174. A metal tubular ferrule 126 is then inserted into end 130 of longitudinal bore 122 of bushing 118 until the ferrule end 168 abuts surface 162 at which point solder stripe 172 will be adjacent an outer surface 138 of the inner lead. In the embodiment of FIG. 3, insertion of ferrule 126 into bore 122 will cause retaining tab 132 to be cammed by inner surface 196 toward axis 116 thereby urging electrical contact tab 136 to crimp the inner lead 106. Then, the solder stripe 172 is caused to reflow to provide an electrical and mechanical connection of the ferrule 126 to the inner lead 106 by forming solder joint 142. Such reflowing of the solder stripe 172 can be accomplished by heating the solder strip by means of, without limitation, induction heating, conduction heating, hot gas heating, and the like. Such heating can be applied external of the connector 100.

The embodiment which have been described herein are but some of several which utilize this invention and are set forth here by way of illustration but not of limitation. It is apparent that many other embodiments which will be readily apparent to those skilled in the art may be made without departing materially from the spirit and scope of this invention.

I claim:

1. A method of joining a connector to a shielded coaxial cable comprising the steps of:

stripping an end of said cable to expose a length of an inner lead and a length of shield layer;

folding said length of shield layer back upon an outer surface of said cable;

inserting a non-conductive bushing, having a longitudinal bore extending therethrough along a longitudinal axis of said bushing, into a first end of an elongated metal tubular connector housing;

affixing said first end of said housing to said bushing;

inserting said end of said cable to an opposite second end of said housing such that said length of inner lead extends into one end of said longitudinal bore along said longitudinal axis;

affixing said opposite second end of said housing to said cable;

inserting a metal tubular ferrule, having an inner portion which protrudes toward said longitudinal axis and which includes a solder strip, into an opposite other end of said longitudinal bore along said longitudinal axis until said solder strip is adjacent an outer surface of said inner lead; and reflowing said solder to electrically and mechanically connect said ferrule to said inner lead.

2. The method of claim 1 wherein said stripping step includes the step of exposing a length of an inner lead insulator of said cable.

3. The method of claim 2 wherein the first affixing step includes the step of crimping said first end of said housing to said bushing and wherein the second affixing step includes the step of crimping said opposite second end of said housing to said cable.

4. The method of claim 3 wherein said inserting of said ferrule into said opposite other end of said longitudinal bore includes the further step of camming said inner portion until said inner portion crimps said inner lead.

5. The method of claim 4 wherein said reflowing step includes heating said solder strip by induction heating.

6. The method of claim 4 wherein said reflowing step includes heating said solder strip by conduction heating.

7. The method of claim 4 wherein said reflowing step includes heating said solder strip by hot gas heating.

* * * * *